US007122157B2

(12) United States Patent
Stevens et al.

(10) Patent No.: US 7,122,157 B2
(45) **Date of Patent: *Oct. 17, 2006**

(54) SPECIMEN LABEL

(75) Inventors: Timothy A. Stevens, Warwick, NY (US); Robert S. Golabek, Jr., Towaco, NJ (US); Steven Savitz, Teaneck, NJ (US); Hugh T. Conway, Verona, NJ (US); Connie Hetzler, Sparta, NJ (US); Eric Bainbridge, Plymouth (GB)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/454,947

(22) Filed: Jun. 5, 2003

(65) Prior Publication Data

US 2003/0206831 A1 Nov. 6, 2003

(51) Int. Cl.
*B01L 3/00* (2006.01)

(52) U.S. Cl. ..... 422/102; 422/99; 422/100; 283/100; 283/101; 283/103; 283/105

(58) Field of Classification Search ..... 422/73, 422/99, 100, 102, 104; 436/69, 70; 435/296, 435/297; 283/98–101, 103, 105, 900
See application file for complete search history.

(56) References Cited

U.S. PATENT DOCUMENTS 1,707,723 A * 4/1929 Hulsebos ..... 40/630
4,476,381 A * 10/1984 Rubin ..... 235/375
4,637,635 A * 1/1987 Levine ..... 283/101
4,700,976 A * 10/1987 Loose ..... 283/101
4,857,716 A * 8/1989 Gombrich et al. ..... 235/375
5,030,341 A * 7/1991 McEwen et al. ..... 210/94
5,219,183 A * 6/1993 McKillip ..... 283/62
5,342,093 A * 8/1994 Weernink ..... 283/81
5,642,906 A * 7/1997 Foote et al. ..... 283/67
5,793,030 A * 8/1998 Kelly, Jr. ..... 235/385
5,893,587 A * 4/1999 Wong ..... 283/98
5,900,610 A * 5/1999 Kelly, Jr. ..... 235/385
5,912,981 A * 6/1999 Hansmire et al. ..... 382/116
6,083,342 A * 7/2000 Frey ..... 156/297
6,127,013 A * 10/2000 Todd ..... 428/40.1
6,136,129 A * 10/2000 Petkovsek ..... 156/247
6,273,986 B1 * 8/2001 Egan ..... 156/277
6,599,481 B1 * 7/2003 Stevens et al. ..... 422/102

FOREIGN PATENT DOCUMENTS

JP 11-161176 * 6/1999 ..... 422/102

* cited by examiner

*Primary Examiner*—Jill Warden
*Assistant Examiner*—Dwayne K. Handy
(74) *Attorney, Agent, or Firm*—Mark Lindsey; Mark J. Schildkraut

(57) ABSTRACT

A substrate removably attached to a container that can be linked electronically to the operating stations in a laboratory and/or removed and subsequently attached to a document or another container. More particularly, the substrate is a partitioned label with human readable information and electronically readable information.

14 Claims, 8 Drawing Sheets

SPECIMEN LABEL

BACKGROUND OF THE INVENTION

1. Field of Invention

This invention relates to containers or vessels for collecting fluid samples from patients, that comprise means for containing and sharing information about the contents of the fluid samples in the container and the patient. More particularly, this invention relates to a means that is removably affixed to a vessel or container that can be linked electronically to the operating stations in a laboratory and/or removed mechanically and subsequently attached to another document or container.

2. Description of Related Art

Test specimens are typically collected by a medical technician, preferably at a medical facility, for testing in a container. Specimens, such as blood, are placed in containers called blood collection tubes and transported or shipped to a test facility together with test request documents.

It is important that once the specimen is collected in a container, that the donor of the specimen is properly identified. Incorrect identification could result in various misdiagnosis. Any indication that the specimen is not properly identified would require recollection. The test facility matches the blood collection tubes and test request documents received from the medical facility, performs the prescribed tests indicated by the test request document on the specimens and reports the test results to the medical facility.

Often, a physician may request multiple tests for one patient. Therefore, tests carried out by a test facility involve several thousand items, and the sizes and shapes of the containers that hold the specimens also include several dozen types. Therefore, laboratory facilities can be faced with managing thousands of requests per day. This presents many challenges in assuring that results are accurately transcribed back to the requesting physician and then ultimately to the patient.

In current laboratory settings, there are several ways that a container containing a specimen can arrive in a laboratory. For example, a container is transported from the collection site with a separate document such as a test request to the testing facility. The personnel at the testing facility receive these separate items and begin processing them together. This can involve entering data from the test request into a computer that electronically links test request information to information about the patient that is already available in the computer system. Additional steps may include obtaining some type of label and attaching it to the container.

These processing steps are subject to human error which could result with inaccurate information and tests results. Therefore, a need exists to link patient, test specimen and test request information that is efficient, cost effective, will enhance the accuracy of reporting test results and will eliminate the need for secondary labeling of containers.

Currently, collection containers are over-labeled with an identifier to control and monitor the specimens prior to and during processing. In most cases, and for those laboratories using integrated, automated systems for specimen processing, the identifier is a barcode.

There exists a need to improve the efficiency of systems for specimen processing whereby information can be easily found on the collection container.

SUMMARY OF THE INVENTION

The present invention is a means for providing electronic information onto or into substrates that can be placed onto, uncoded or embedded with a container prior to the container being used as a specimen collection device.

Preferably, the substrate may contain human readable information from the label or the collection vessel.

Preferably, the substrate may contain electronic information technology that can be activated, scanned, transferred and stored into other media.

Most preferably, the substrate includes a means for detaching a portion of the substrate for use with related documents or other related containers.

The present invention is a collection container comprising a label that comprises a machine readable barcode identification and a portion of the label and barcode can be removed from the container and subsequently affixed to test request forms and the like. The label of the present invention is able to create a direct link between the container, the patient and the test request forms.

Preferably, the label of the present invention comprises a permanent section and a peel away section. Most preferably, a double bar code is on the label wherein the permanent section and the peel away section of the label share the barcode information and features. In addition to the barcode information on the label, the label may also contain a writing area and/or be color coordinated with other information such as the type of container it is associated with.

Preferably, the bar code information contains information regarding the tube, the test requirements to be performed and/or patient identification.

Most preferably, the peel away section comprises a tab that allows the user to quickly and efficiently remove the peel away section from the label and attach it to a document or another container.

Most preferably, the size of the double bar code is such that it can surround the container with a wrap angle of up to about 360°. Therefore, misreading of the bar code by electronic devices is substantially minimized because alignment of the electronic device or scanner and label is not required. The bar code angle wrap provides an improved interface with both manual and automatic bar code scanning devices. In the testing laboratory, some automation tube handling systems will transport the tubes on a track to various testing stations in the laboratory environment. The tube, with a bar code label and a small angle wrap, is rotated while scanned to ensure high quality bar code reads at various points along the track. Therefore, the bar code label with a wide angle wrap minimizes the rotation necessary to read the bar code, thereby increasing the production rate of the testing stations in the laboratory.

Preferably, a bar code wrap angle of 360° will provide a means for the automated equipment to read the bar code with minimal rotation and less time.

In use, the label is on a container that is subsequently used in a specimen collection procedure. The barcode on the label contains human readable information and/or electronic information that can be activated, scanned, transferred and stored into other media. Once a specimen is collected, the peel away section of the label is removed and applied to a test request form.

The label of the present invention minimizes the amount of curl-up associated with the inherent material characteristics of pulling and peeling action.

Most notably, the double barcode label of the present invention allows the customer to create a direct link between the patient form, patient and specimen/tube.

DETAILED DESCRIPTION

Figure 1:
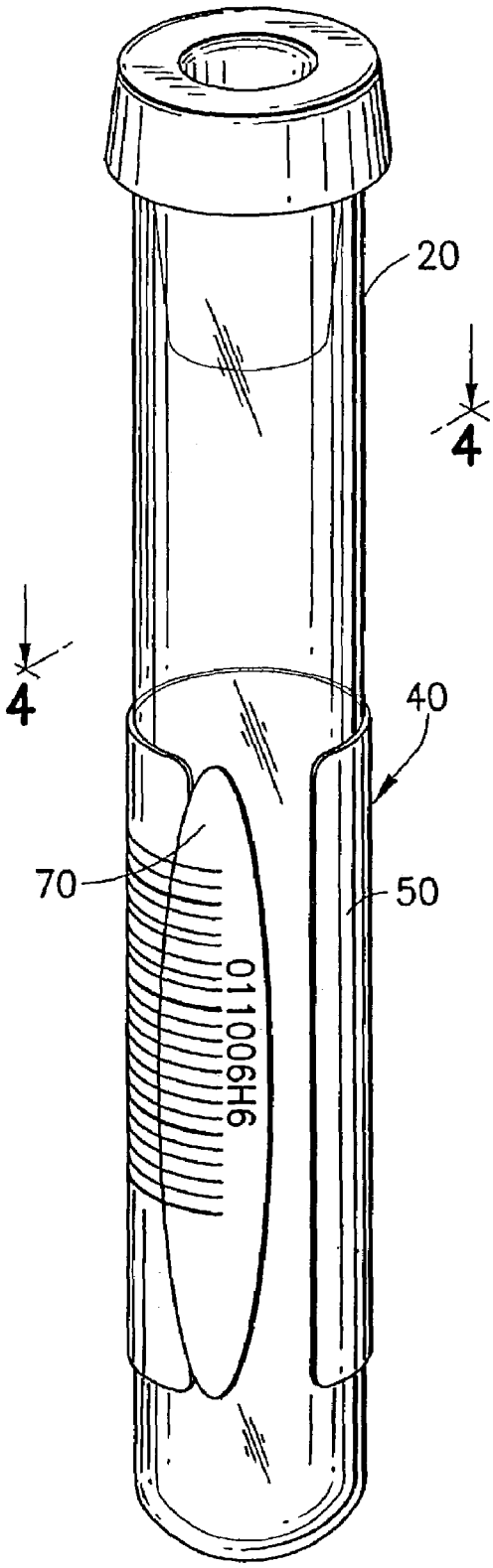
FIG. 1 is a perspective view of a tube with the label of the present invention.

While this invention is satisfied by embodiments in many different forms, there is shown in the drawings and will herein be described in detail, the preferred embodiments of the invention, with the understanding that the present disclosure is to be considered as exemplary of the principles of the invention and is not intended to limit the invention to the embodiments illustrated. Various other modifications will be apparent to and readily made by those skilled in the art without departing from the scope and spirit of the invention. The scope of the invention will be measured by the appended claims and their equivalents.

FIG. 1 illustrates a sample collection tube 20 and a label 40. Label 40 comprises a permanent portion 50 and a peel away portion 70.

Figure 2:
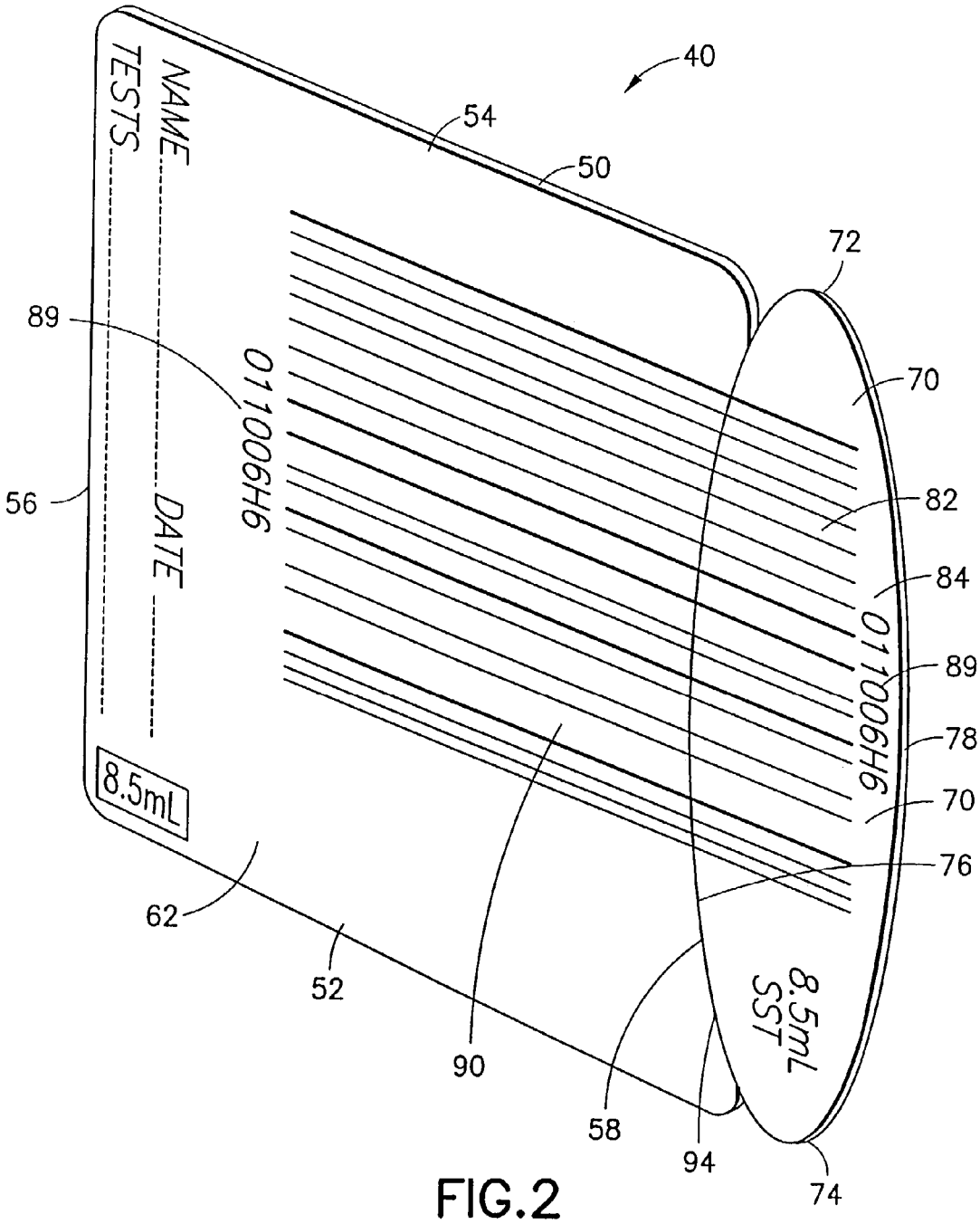
FIG. 2 is a perspective view of the label of the present invention of FIG. 1.
Figure 3:
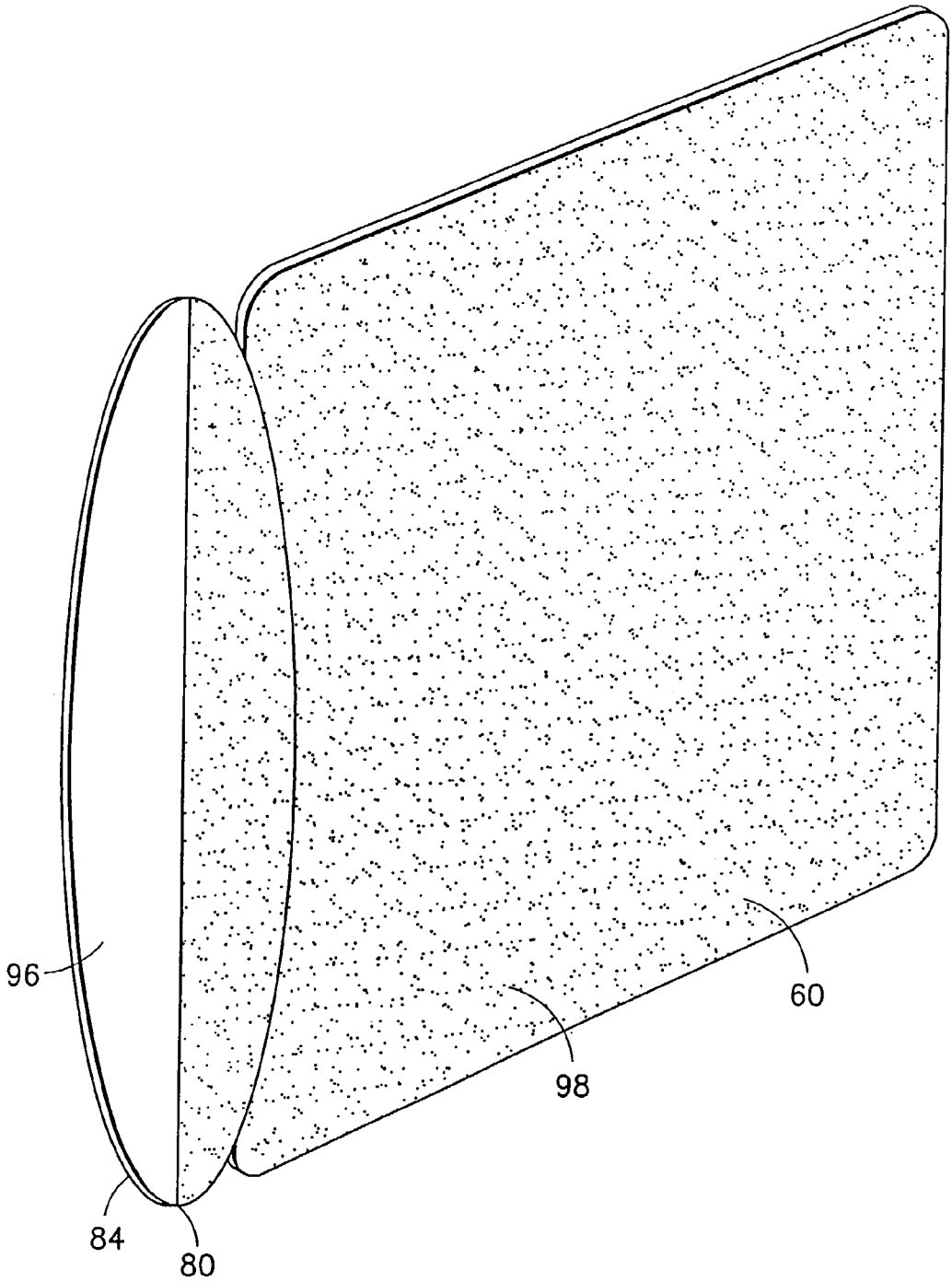
FIG. 3 is a perspective view of the bottom or underside of the label of the present invention of FIG. 1.

As shown in FIGS. 1, 2 and 3, permanent portion 50 comprises a first side 52, a second side 54, a third side 56, a fourth side 58, a bottom side or an underside 60 and a top side 62. First side 52 is across from second side 54 and third side 56 is across from fourth side 58. Although it is within the purview of the invention that fourth side 58 may be a geometric shape, for purposes of illustration an elliptical shape is shown in FIGS. 2 and 3. In addition, bottom side 60 includes an adhesive 98 for attaching the label to a container.

As shown in FIGS. 1, 2 and 3, peel away portion 70 includes a first side 72, a second side 74, and a third side 76, a fourth side 78, a bottom side 80 and a top side 82. Peel away portion 70 further includes a dead-ended lift tab 84 comprising a non-stick portion 96 so that the peel away portion may be easily grasped and removal from the container is facilitated. The non-stick portion is located on bottom side 80 near fourth side 78. The remaining area of bottom side 80 includes an adhesive 98 for attaching the label to a container or a document. Although it is within the purview of the invention that peel away portion 70 may be a geometric shape for purposes of illustration an elliptical shape is shown in FIGS. 1, 2 and 3.

Peel away portion 70 and permanent portion 50 are joined by a perforation 94 at fourth side 58 of the permanent portion and third side 76 of the elliptical portion.

The label further includes a tandem double barcode 90 located on top side 62 of permanent portion 50 and extending onto top side 82 of the peel away portion 70. The double barcode design is of a size so that it extends approximately 180° or more around the container.

As shown in FIG. 2, the same or tandem digit and/or alphanumeric combination 89 is located on the peel away section and the permanent section of the label. The first two of the digits are fixed and identify the tube and product type for features such as but not limited to tube size, tube material and internal additives. These first two digits allow automatic laboratory systems to recognize what type of collection vessel it is handling to facilitate more efficient processing of handling operations. The remaining alphanumeric elements can range in number but are preferred to be five or six digits and are most preferably six digits that are a base thirty-one alphanumeric unique identifier. The advantage of such a ten-digit bar code is that some of the digits can be used to identify the manufacturing location.

Most preferably, label 40 is applied to a container by an automated manufacturing process so that the label is pre-attached to the container prior to being used by a medical facility and/or prior to being transported to a testing facility.

Most preferably, perforation 94 is a micro-perforation wherein the user initiates the removal of the peel away portion.

Figure 4:
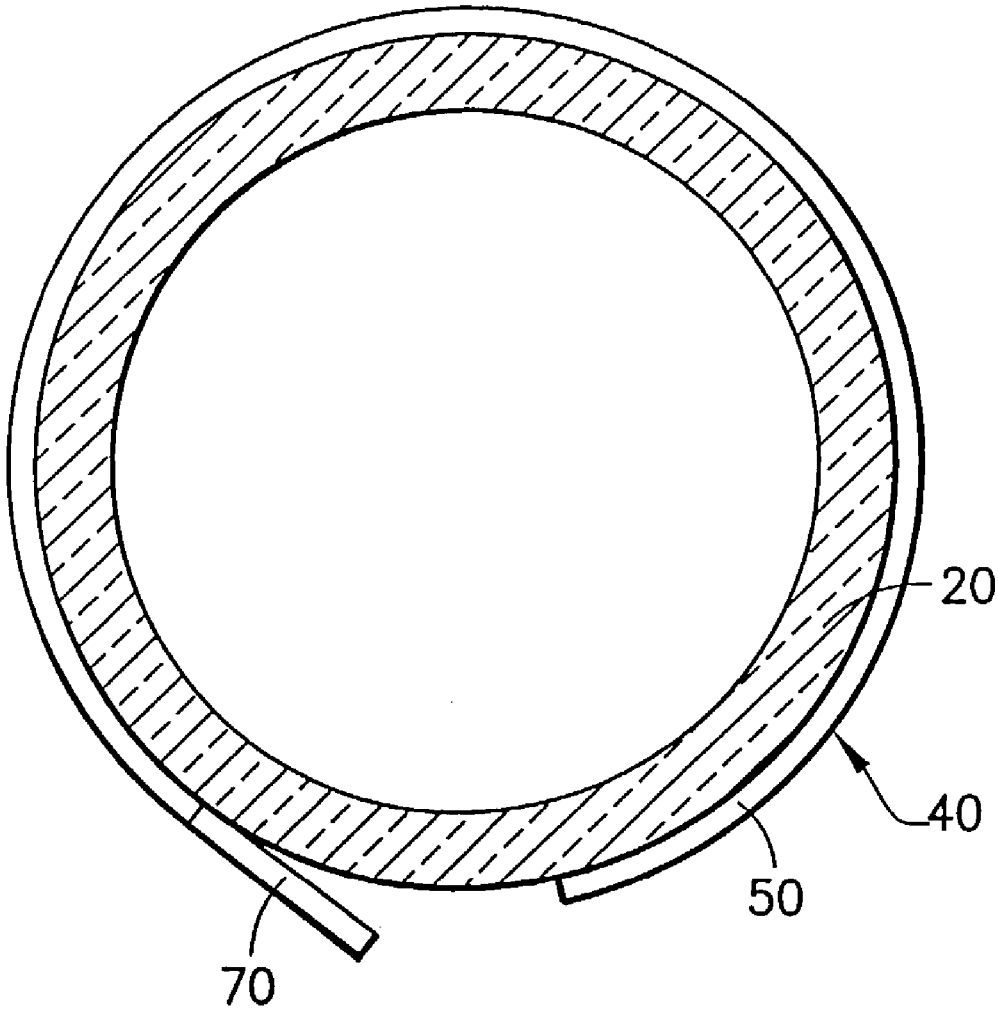
FIG. 4 is a cross-sectional view of the tube with the label of FIG. 1 taken along 4-4 thereof.
Figure 5:
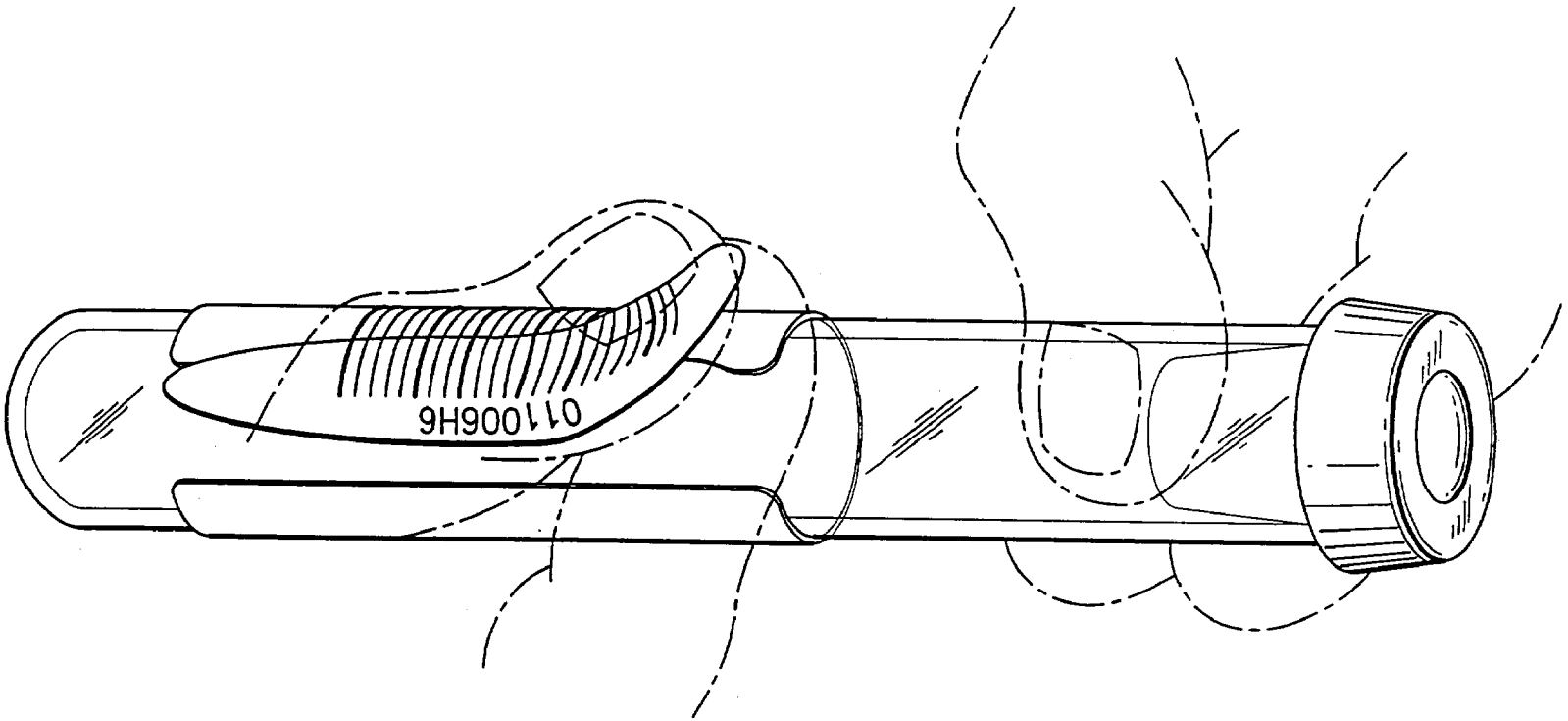
FIG. 5 illustrates the user peeling a portion of the label from the tube.
Figure 6:
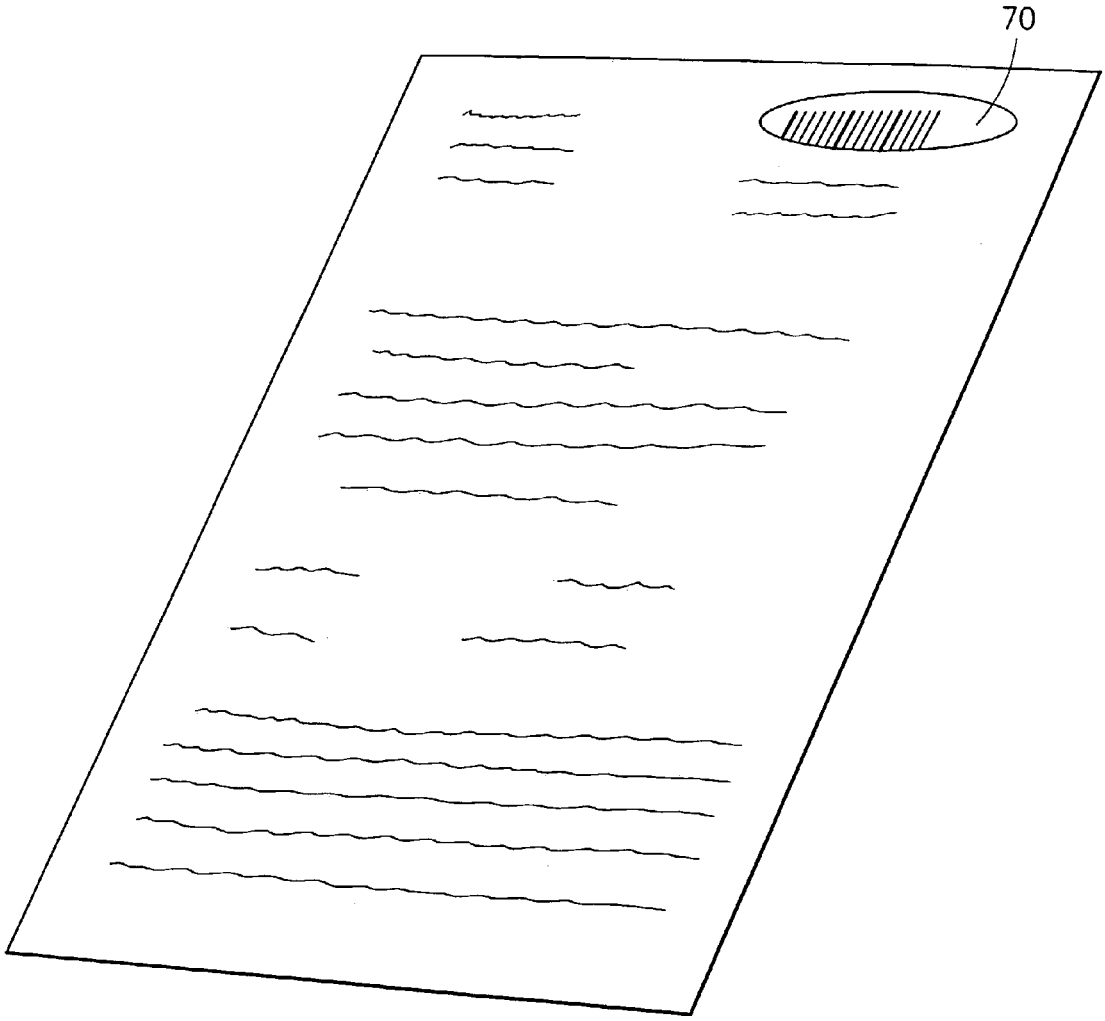
FIG. 6 illustrates the side peel being affixed to a client document.

In use, as shown in FIG. 4, the label is attached to a tube. As shown in FIG. 5 the user grips lift tab 84 of peel away portion 70 and peels and pulls the portion towards the user whereby peel away portion 70 is detached from the permanent portion of the label. The user then affixes the peel away portion to a test request form as shown on FIG. 6 or to another container or item as may be required.

The lift tab is easily grasped and facilitates removal of the peel away portion from a container. The lift tab is particularly advantageous to users in medical or test facilities who wear protective gloves.

The peeling and pulling load of the elliptical shape of the peel away portion assists in distributing the load over a large area as compared to a traditional straight line perforation. Distributing the peeling and pulling load across an elliptical shape substantially prevents curl-up of the peel away portion. Curl-up of the peel away portion could prevent the user from using the portion or affixing it to the client order or test request form and it also reduces the necessary force to remove it.

The elliptical micro-perforation also prevents tear away from the perforation line that occurs when the adhesive forces exceed the label tear strength which in turn renders information on the label non-readable.

The elliptical lift tab avoids wrinkled corners as may be present on right angled labels and it eases placement of the tube into test tube racks without the label getting caught on the rack.

Although the peel away portion of the label in accordance with the present invention is an elliptical shape, it is within the purview of this invention that any shape that permits the distribution of the peeling and pulling load so that curl-up or tearing is minimized may be well suited to be used in the present invention.

Although the container in accordance with the present invention may be a sample collection tube or a culture bottle, other containers may be well suited to be used with the label of the present invention.

Figure 7:
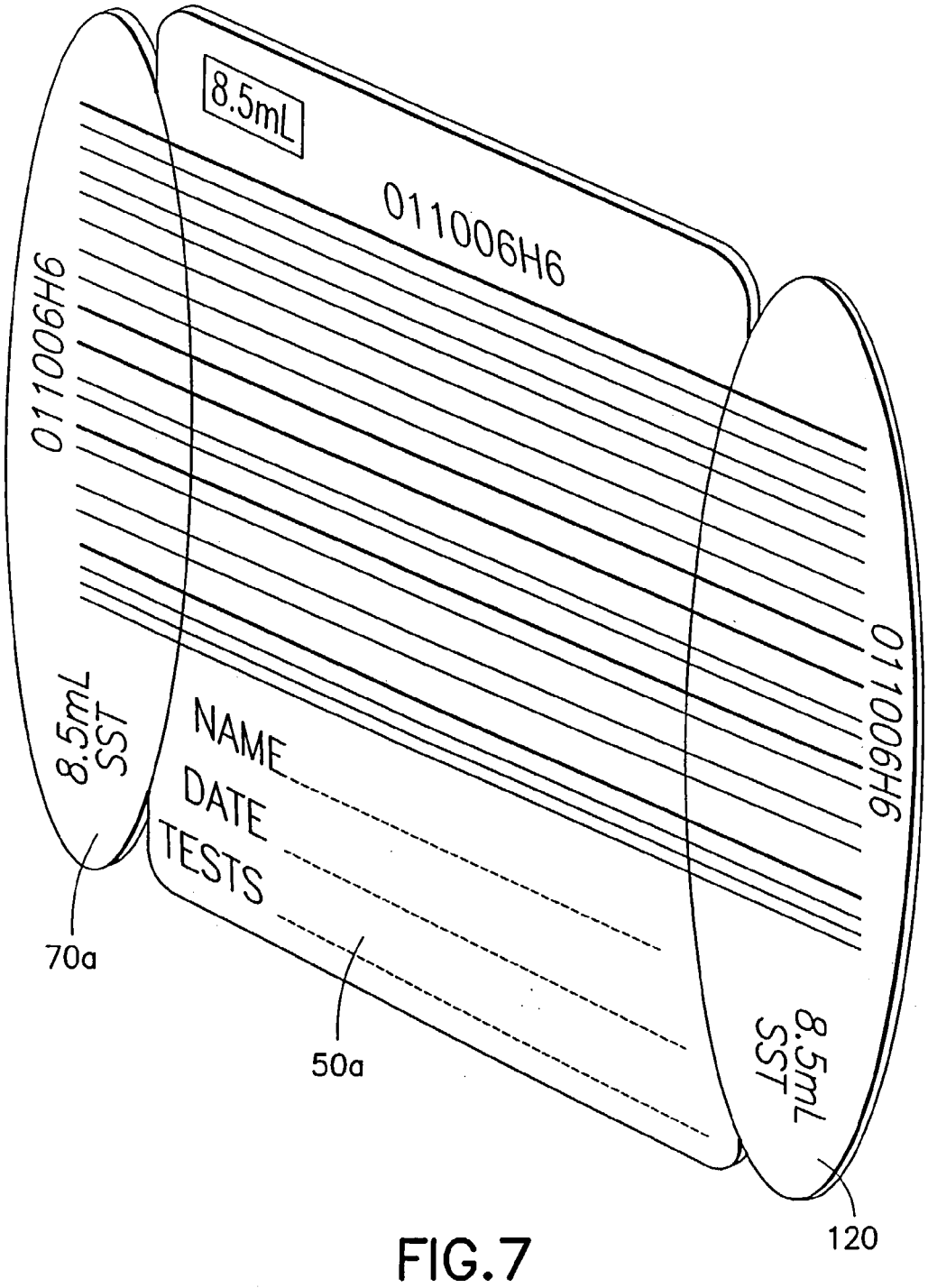
FIG. 7 is an alternate embodiment of the invention.

The alternate embodiment as shown in FIG. 7 includes many components which are substantially identical to the components of FIGS. 2 and 3. Accordingly, similar components performing similar functions will be numbered identically to those components of FIGS. 2 and 3, except that a suffix "a" will be used to identify those similar components in FIG. 7.

The alternate embodiment of the label of the present invention is illustrated in FIG. 7. As shown in FIG. 7, the label contains a second peel away portion 120.

Figure 8:
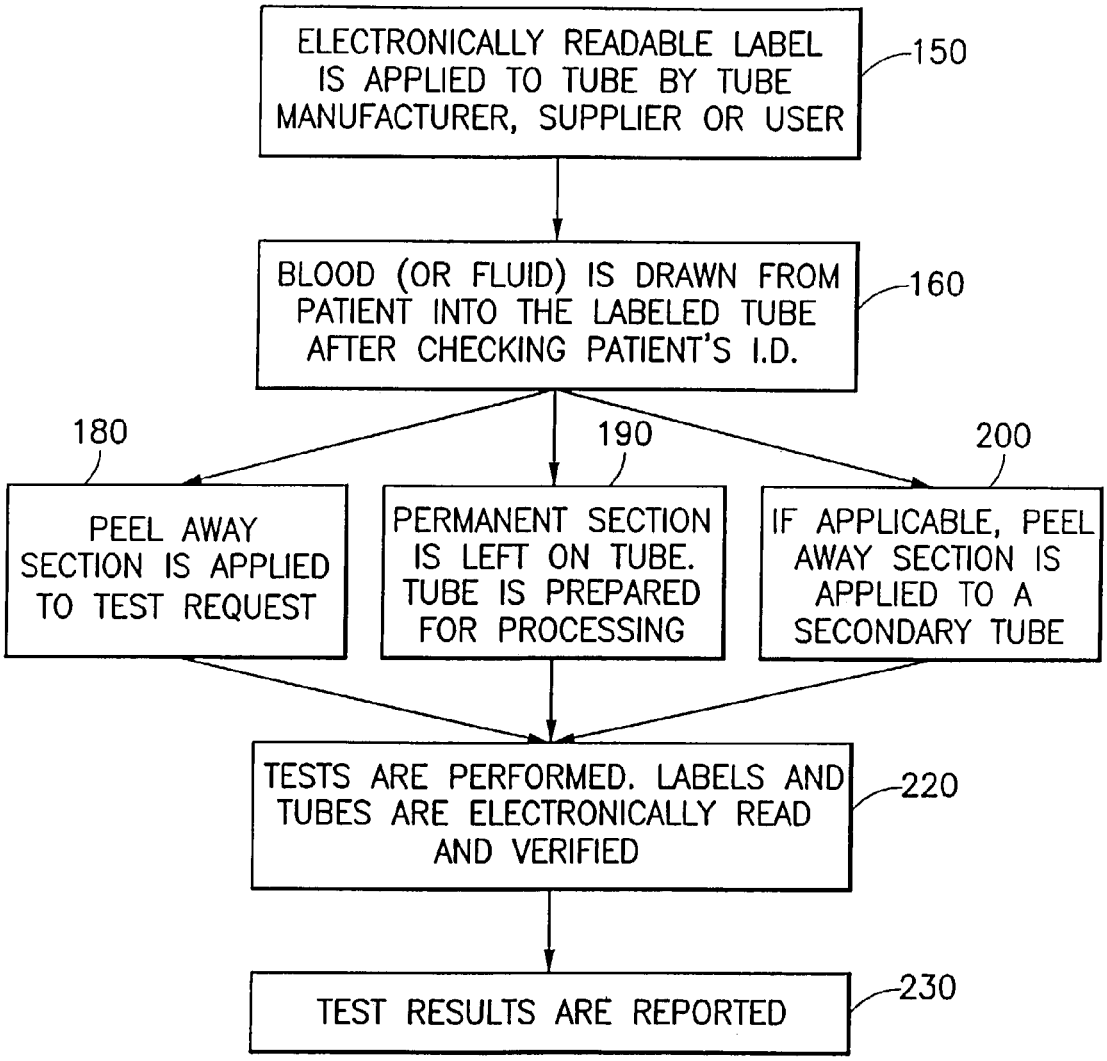
FIG. 8 illustrates a flow chart according to the method of using the label system of the present invention.

As shown in FIG. 8, the system and method for using the label of the present invention is illustrated. As depicted in 150 in the box diagram of FIG. 8, label 40 is applied to a tube. A sample is then drawn from a patient into the tube with the label as depicted in 160 in the box diagram of FIG. 8. As shown in alternative steps 180, 190 and 200, peel away portion 70 of the label may be applied to a test request form, may be left on the tube or applied to a secondary tube. As shown in step 220, tests are then performed on the patient's sample and the label and tube information is electronically read. As shown in step 230, the test results are then reported.

What is claimed:

1. A biological sample collection container comprising:

an inner surface for receiving the biological sample, an outer surface, and a label assembly on the outer surface, the label assembly comprising:

a permanent section; and a peel away section; and readable information printed on said label assembly;

wherein at least a portion of an edge of said permanent section is positioned adjacent to at least a portion of an edge of said peel away section, wherein said peel away section is capable of being removed from said outer surface while said permanent section remains on said outer surface, such that said peel away section and said permanent section each have, said readable information thereon, and wherein a first portion of said peel away section comprises adhesive and a second portion of said peel away section is free of adhesive.

2. The collection container of claim 1, wherein said peel away section comprises an elliptical shape.

3. The collection container of claim 1, wherein said permanent section and said peel away section are removably joined by a perforation.

4. The collection container of claim 1, wherein said container is a tube.

5. The collection container of claim 1, wherein said collection container comprises a top portion, a bottom portion, and a tubular sidewall extending between the top and bottom portions.

6. The collection container of claim 1, wherein said permanent section and said peel away section form one label.

7. The collection container of claim 1, wherein said readable information on said permanent section and said peel away section is identical.

8. The collection container of claim 1, wherein said readable information on said permanent section is associated with said readable information on said peel away section.

9. The collection container of claim 1, wherein said readable information is electronically readable information.

10. The collection container of claim 1, wherein said readable information is human readable information.

11. The collection container of claim 1, wherein said readable information is both human readable information and electronically readable information.

12. The collection container of claim 1, wherein said readable information is a bar code.

13. The collection container of claim 1, wherein said peel away section is shaped for reducing curl-up of said peel away section that is caused by removal of said peel away section from said outer surface.

14. The collection container of claim 13, wherein said peel away section comprises an elliptical shape.

* * * * *